US011274476B2

(12) United States Patent
Vazquez et al.

(10) Patent No.: US 11,274,476 B2
(45) Date of Patent: Mar. 15, 2022

(54) APPARATUS AND METHOD FOR PROVIDING A BYPASS FEATURE IN A LATCH

(71) Applicant: Inteva Products, LLC, Troy, MI (US)

(72) Inventors: Francisco Javier Vazquez, Chihuahua (MX); Ari Mino, Chihuahua (MX); Alfredo Martinez, Chihuahua (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 166 days.

(21) Appl. No.: 16/592,607

(22) Filed: Oct. 3, 2019

(65) Prior Publication Data

US 2020/0032559 A1 Jan. 30, 2020

Related U.S. Application Data

(62) Division of application No. 14/541,697, filed on Nov. 14, 2014, now Pat. No. 10,472,865.

(Continued)

(51) Int. Cl.

| | |
|---|---|
| ***E05B 81/06*** | (2014.01) |
| ***E05B 81/16*** | (2014.01) |
| ***E05B 81/36*** | (2014.01) |

(52) U.S. Cl.

CPC ..... *E05B 81/06* (2013.01); *E05B 81/16* (2013.01); *E05B 81/36* (2013.01); *Y10S 292/23* (2013.01);

(Continued)

(58) Field of Classification Search

CPC ..... Y10T 292/108; Y10T 292/1082; Y10T 292/1092; Y10T 292/1047; Y10S 292/23; E05B 81/06; E05B 81/16; E05B 81/36

See application file for complete search history.

(56) References Cited

U.S. PATENT DOCUMENTS

| | | | |
|---|---|---|---|
| 3,695,662 | A | 10/1972 | Ploughman |
| 3,969,789 | A | 7/1976 | Wize |

(Continued)

FOREIGN PATENT DOCUMENTS

| | | | |
|---|---|---|---|
| CN | 103132823 | B | 9/2015 |
| DE | 29623782 | U1 | 5/1996 |
| EP | 0603934 | A1 | 12/1993 |

OTHER PUBLICATIONS

English Translation to Office Action for Application No. 201410649461.1; dated Jun. 20, 2016.

(Continued)

*Primary Examiner* — Christine M Mills
*Assistant Examiner* — Faria F Ahmad
(74) *Attorney, Agent, or Firm* — Cantor Colburn LLP

(57) ABSTRACT

A latch having: a fork bolt movably mounted thereto; a detent lever movably mounted thereto, wherein the detent lever prevents the fork bolt from moving from a closed position to an open position when the detent lever is in a latched position; a bell crank lever movably mounted to the latch for movement between a first position and a second position, wherein the bell crank lever moves the detent lever from the latched position to the released position as the bell crank lever moves from the first position to the second position; a release lever movably mounted to the latch for movement between a first position and a second position; and an intermittent pin operatively coupled to bell crank lever and the release lever, wherein movement of the release lever is not transferred to the bell crank lever when the intermittent pin is in the second position.

15 Claims, 6 Drawing Sheets

Related U.S. Application Data

(60) Provisional application No. 61/904,905, filed on Nov. 15, 2013.

(52) U.S. Cl.
CPC ..... *Y10T 292/108* (2015.04); *Y10T 292/1047* (2015.04); *Y10T 292/1052* (2015.04); *Y10T 292/1075* (2015.04); *Y10T 292/1078* (2015.04); *Y10T 292/1082* (2015.04); *Y10T 292/1092* (2015.04)

(56) References Cited

U.S. PATENT DOCUMENTS 5,667,260 A 9/1997 Weyerstall
5,802,894 A 9/1998 Jahrsetz et al.
5,918,917 A * 7/1999 Elton ..... E05B 81/20 292/201
5,997,055 A 12/1999 Strathmann
6,019,402 A * 2/2000 Arabia, Jr. ..... E05B 81/06 292/201
6,053,543 A 4/2000 Arabia, Jr. et al.
6,382,687 B1 5/2002 Gruhn
6,499,776 B2 * 12/2002 Takamura ..... E05B 81/20 292/201
6,511,106 B2 * 1/2003 Perkins ..... E05B 81/16 292/216
6,568,741 B1 5/2003 Leung et al.
6,575,507 B2 6/2003 Reddmann
6,679,531 B2 1/2004 Rogers, Jr. et al.
7,210,714 B2 5/2007 Berghahn et al.
8,348,310 B2 1/2013 Vazquez et al.
8,480,138 B2 * 7/2013 Bendel ..... E05B 85/26 292/201
8,876,176 B2 11/2014 Spurr et al.
8,955,889 B2 2/2015 Bendel et al.
9,194,162 B2 * 11/2015 Perkins ..... E05B 77/12
9,322,198 B2 * 4/2016 Kovie ..... E05B 85/243
9,428,943 B2 * 8/2016 Mitchell ..... E05B 85/02
2001/0005079 A1 6/2001 Takamura
2002/0074805 A1 * 6/2002 Perkins ..... E05B 81/16 292/14
2002/0074806 A1 * 6/2002 Perkins ..... E05B 81/34 292/14
2002/0089188 A1 7/2002 Edgar
2002/0117863 A1 * 8/2002 Shinkawa ..... E05B 81/34 292/216
2003/0116977 A1 6/2003 Erices
2003/0127866 A1 7/2003 Martinez et al.
2004/0075284 A1 4/2004 Hillgaertner
2004/0201226 A1 10/2004 Spurr
2004/0227358 A1 11/2004 Kachouh
2005/0087994 A1 4/2005 Umino
2005/0218662 A1 * 10/2005 Umino ..... E05B 77/34 292/216
2006/0006670 A1 1/2006 Song
2006/0006671 A1 1/2006 Noel et al.
2006/0163883 A1 7/2006 Hoshikawa et al.
2007/0040391 A1 * 2/2007 Fujihara ..... E05B 81/20 292/201
2007/0210588 A1 * 9/2007 Cetnar ..... E05B 77/28 292/216
2008/0217928 A1 9/2008 Spurr
2010/0052336 A1 3/2010 Bendel et al.
2010/0127511 A1 5/2010 Vasquez et al.
2010/0127512 A1 5/2010 Vazquez et al.
2010/0244466 A1 9/2010 Tomaszewski
2011/0204659 A1 8/2011 Estrada et al.
2012/0292927 A1 11/2012 Vazquez et al.
2014/0091581 A1 * 4/2014 Taurasi ..... E05B 77/36 292/215
2014/0175809 A1 * 6/2014 Takeuchi ..... E05B 81/06 292/96
2014/0292000 A1 10/2014 Vazquez et al.
2015/0137530 A1 * 5/2015 Vazquez ..... E05B 81/06 292/200
2015/0308163 A1 * 10/2015 Tomaszewski ..... E05B 77/32 292/196
2016/0032630 A1 * 2/2016 Machida ..... E05B 81/20 292/201

OTHER PUBLICATIONS

EP Office Action for Application No. 201410649461.1; dated Feb. 21, 2017.
Office Action for Application No. 201410649461.1; dated Jun. 20, 2016.
Search Report for Application No. 201410649461.1; dated Feb. 21, 2017.
English Machine Translation Abstract of CN103132823.

* cited by examiner

APPARATUS AND METHOD FOR PROVIDING A BYPASS FEATURE IN A LATCH

CROSS REFERENCE TO RELATED APPLICATIONS

This application is a divisional application of U.S. patent application Ser. No. 14/541,697 filed on Nov. 14, 2014, which claims the benefit of U.S. Provisional Patent Application No. 61/904,905 filed on Nov. 15, 2013, the entire contents each of which are incorporated herein by reference thereto.

BACKGROUND

Certain passenger vehicles are equipped with door latches that are capable of being manipulated between a locked state and unlocked state via a mechanical actuator. In some applications, the mechanical actuator is operated via an electrical system or motor. Still further, it may be desirable to allow a manual release mechanism of the latch to be bypassed when the latch is in a locked state or a lock function of the latch is activated. Thus, operation of the manual release mechanism does not transition the latch from a closed position to an open position when it is in a locked state. One example of such a latch is a rear occupant vehicle door latch.

In order to provide this feature or bypass feature numerous components are provided within the latch.

Accordingly, it is desirable to provide a latch or method of operating the latch in an efficient manner that allows for such a bypass feature to be provided in an efficient and durable configuration without adding to the complexity of the latch configuration.

SUMMARY OF THE INVENTION

In one non-limiting embodiment, a vehicle latch is provided. The latch having: a fork bolt movably mounted to the latch for movement between an open position and a closed position; a detent lever movably mounted to the latch for movement between a latched position and a released position, wherein the detent lever prevents the fork bolt from moving from the closed position to the open position when the detent lever is in the latched position; a bell crank lever movably mounted to the latch for movement between a first position and a second position, wherein the bell crank lever moves the detent lever from the latched position to the released position as the bell crank lever moves from the first position to the second position; a release lever movably mounted to the latch for movement between a first position and a second position; and an intermittent pin operatively coupled to bell crank lever and the release lever, wherein the intermittent pin is movably mounted to the bell crank lever and the release lever for movement between a first position and a second position, wherein movement of the release lever is not transferred to the bell crank lever when the intermittent pin is in the second position.

In another embodiment, a vehicle door latch is provided. The vehicle door latch having: a fork bolt movably mounted to the latch for movement between an open position and a closed position; a detent lever movably mounted to the latch for movement between a latched position and a released position, wherein the detent lever prevents the fork bolt from moving from the closed position to the open position when the detent lever is in the latched position; a bell crank lever movably mounted to the latch for movement between a first position and a second position, wherein the bell crank lever moves the detent lever from the latched position to the released position as the bell crank lever moves from the first position to the second position; a release lever movably mounted to the latch for movement between a first position and a second position; an intermittent pin operatively coupled to bell crank lever and the release lever, wherein the intermittent pin is movably mounted to the bell crank lever and the release lever for movement between a first position and a second position, wherein movement of the release lever is not transferred to the bell crank lever when the intermittent pin is in the second position and wherein the second position of the intermittent pin corresponds to a locked state of the latch; and a motor for moving the intermittent pin from its first position to its second position.

In another non-limiting embodiment, a method of disengaging a release lever from a bell crank lever of a vehicle door latch is provided. The method including the steps of: pivotally mounting a fork bolt to the latch for movement between an open position and a closed position; pivotally mounting the detent lever to the latch for movement between a latched position and a released position, wherein the detent lever engages the fork bolt and prevents the fork bolt from moving from the closed position to the open position when the detent lever is in the latched position; movably mounting a bell crank lever to the latch for movement between a first position and a second position, wherein the bell crank lever is configured to move the detent lever from the latched position to the released position as it moves from the first position to the second position; movably mounting a release lever to the latch for movement between a first position and a second position; operatively coupling the bell crank lever to the release lever by an intermittent pin, wherein the intermittent pin is movably mounted to the bell crank lever and the release lever for movement between a first position and a second position, wherein movement of the release lever is not transferred to the bell crank lever when the intermittent pin is in the second position.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
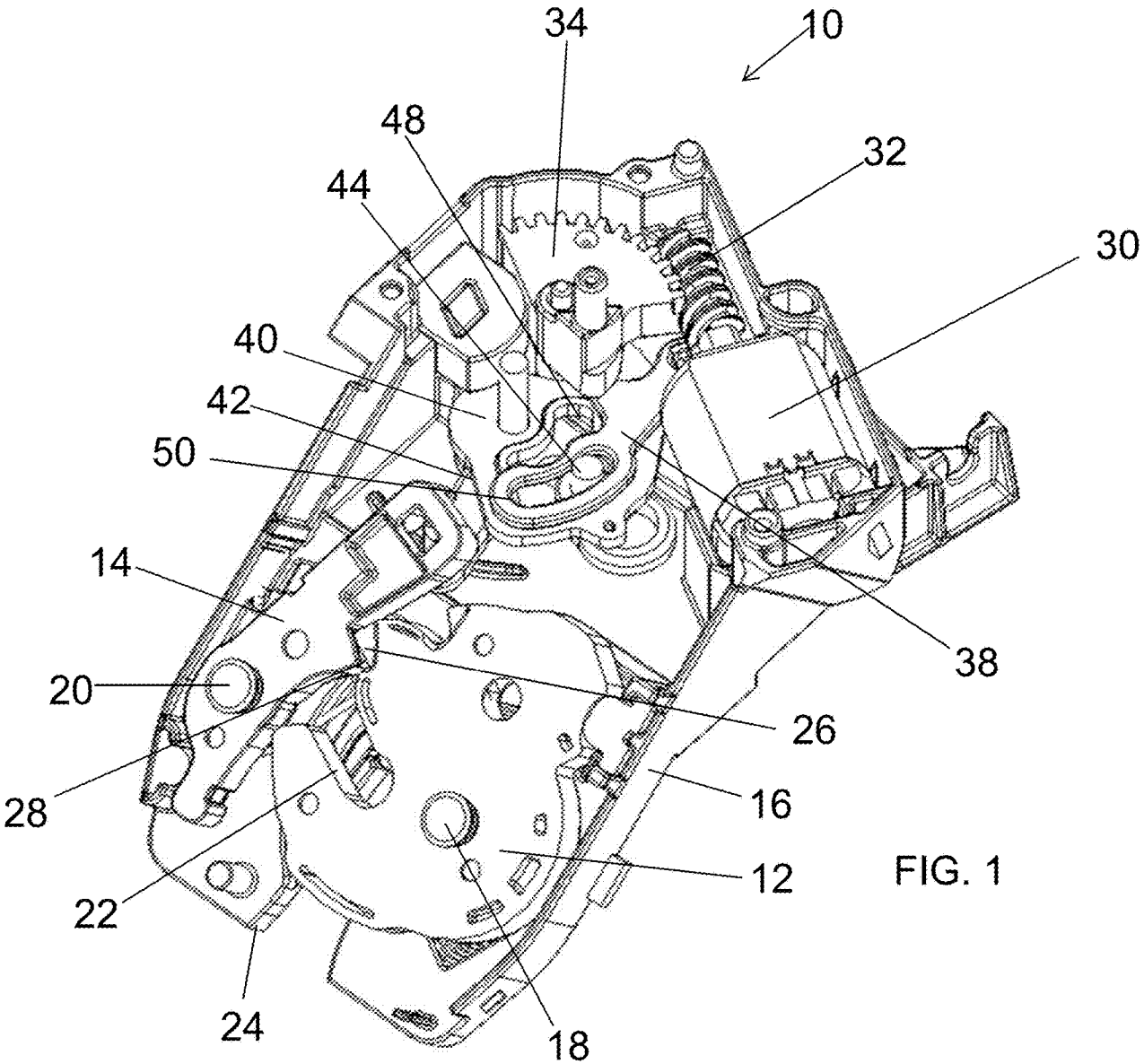
FIG. 1 is a perspective view of a latch in accordance with an embodiment of the present invention.
Figure 2:
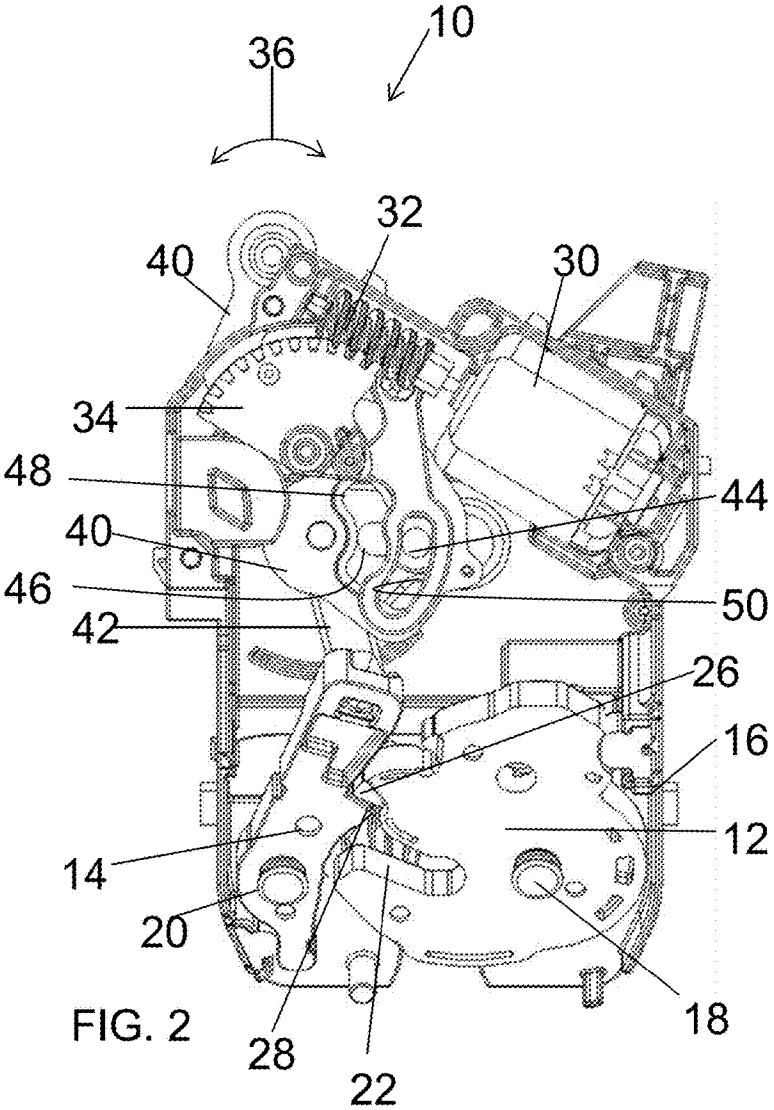
FIG. 2 is a view of the latch in a closed and unlocked position.
Figure 2A:
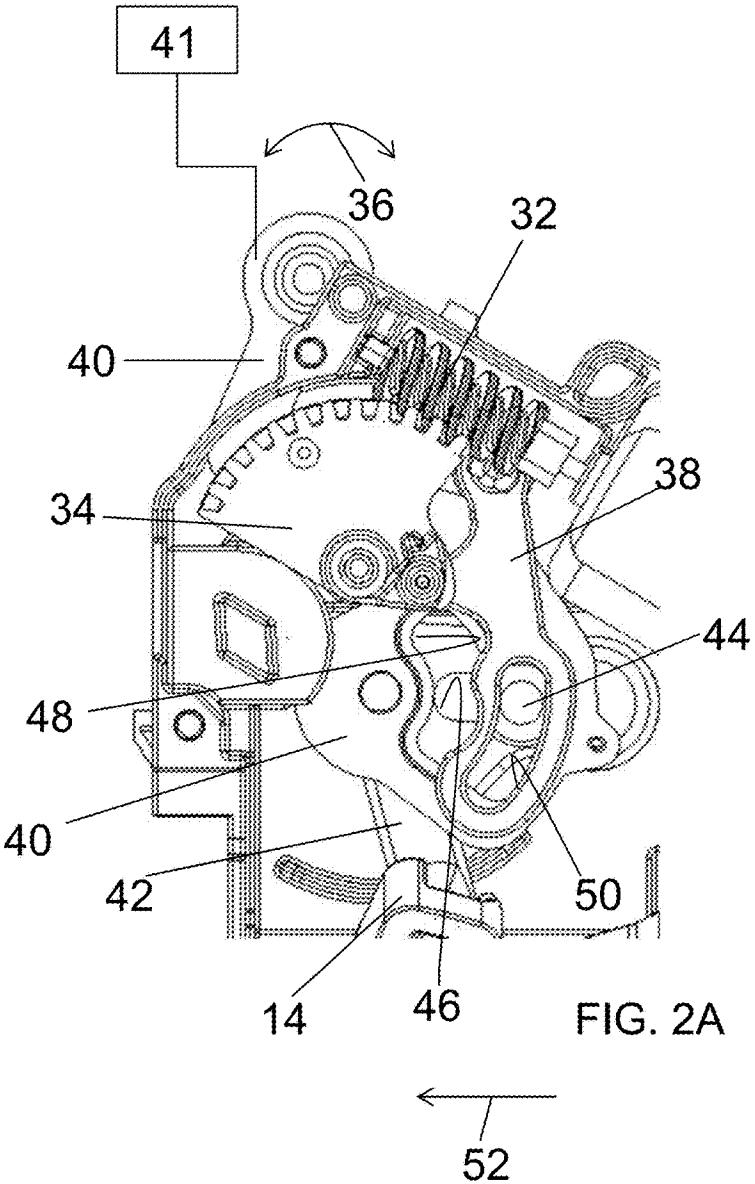
FIG. 2A is an enlarged view of a portion the latch illustrated in FIG. 2.

As mentioned above, it is desirable to provide certain latches with a means for bypassing a manual release mechanism or release lever of the latch when the latch is in a locked state or a lock function of the latch is activated. In one embodiment, this feature may be incorporated into a rear occupant latch of a vehicle.

Reference is made to the following U.S. Pat. Nos. 3,969,789; 6,568,741; 6,679,531; 8,348,310 and U.S. Patent Publication Nos. US 2010/0127512; US 2011/0204659; US 2012/0292927 and provisional Patent Application Ser. No. 61/806,530 filed Mar. 29, 2013, the entire contents each of which are incorporated herein by reference thereto.

Referring now to the FIGS. various embodiments of the invention will be described with reference to specific embodiments, without limiting same, the attached FIGS. shows portions of a latch or latch assembly 10.

In one embodiment, latch 10 is a vehicle door latch. A latch 10 of the type illustrated in the FIGS. is useful for the rear doors of the vehicle. Still further the latch 10 can be used with any vehicle door.

However, the latch 10 is applicable to any environment where the features of various embodiments of the invention are desired. For example, the latch assembly can be attached to a vehicle structure such that the fork bolt is moved between the open position and the closed position when a hood, door, window, lift gate, etc. is opened and closed and the fork bolt engages a striker that is attached to the hood, door, window, lift gate, etc.

Alternatively, the latch or latch assembly 10 can be secured to the hood, door, window, lift gate, etc. and the striker is secured to the vehicle body at an opening into which the hood, door, window, lift gate, etc. is received.

Latch 10 is located on a first element or first vehicle component which is either a frame (e.g., body member surrounding or proximate to an opening the movable member covers) or movable member (e.g., door, window, lift gate, hood, etc.) and includes a fork bolt or claw 12 and a detent lever or pawl 14. Each of which may be pivotally or movably mounted to a housing 16 or another portion or housing of the latch 10. In one non-limiting embodiment, the fork bolt 12 is capable of rotation about first stud or pin 18, while detent lever is a capable of rotation about a second stud or pin 20. During operation, a striker (not shown) is attached to a second element or second vehicle component, which is either the frame or movable member depending on which one has the latch 10 secured thereto.

In accordance with an exemplary embodiment, the fork bolt 12 is capable of movement between a first or latched position or closed position (see at least FIGS. 1, 2, 4 and 5) wherein the striker is engaged by a throat 22 of the fork bolt and a second or unlatched or open position (see at least FIG. 3) wherein the striker is free to be released from the throat 22 of the fork bolt 12. The housing 16 of the latch 10 will also have a complimentary opening 24 for receipt of the striker therein when it is engaged or latched by the fork bolt 12. In one non-limiting embodiment, the fork bolt 12 may be spring biased into the second or open position by a spring or biasing member.

Alternatively or in addition to the spring biasing force applied to the fork bolt 12, the movable member may also be spring biased or biased into an open position such that when the latch 10 is released fork bolt 12 will rotate and release striker. One non-limiting example of an item providing such a force is the compressed weather stripping or sealing member located around the periphery of the opening that is covered by the movable member. In other words, when the door is closed, the sealing member is compressed and the latch 10 engages the striker. Thereafter and when the latch 10 is released, the sealing member may provide an urging force to open the door or gate, etc.

Figure 3:
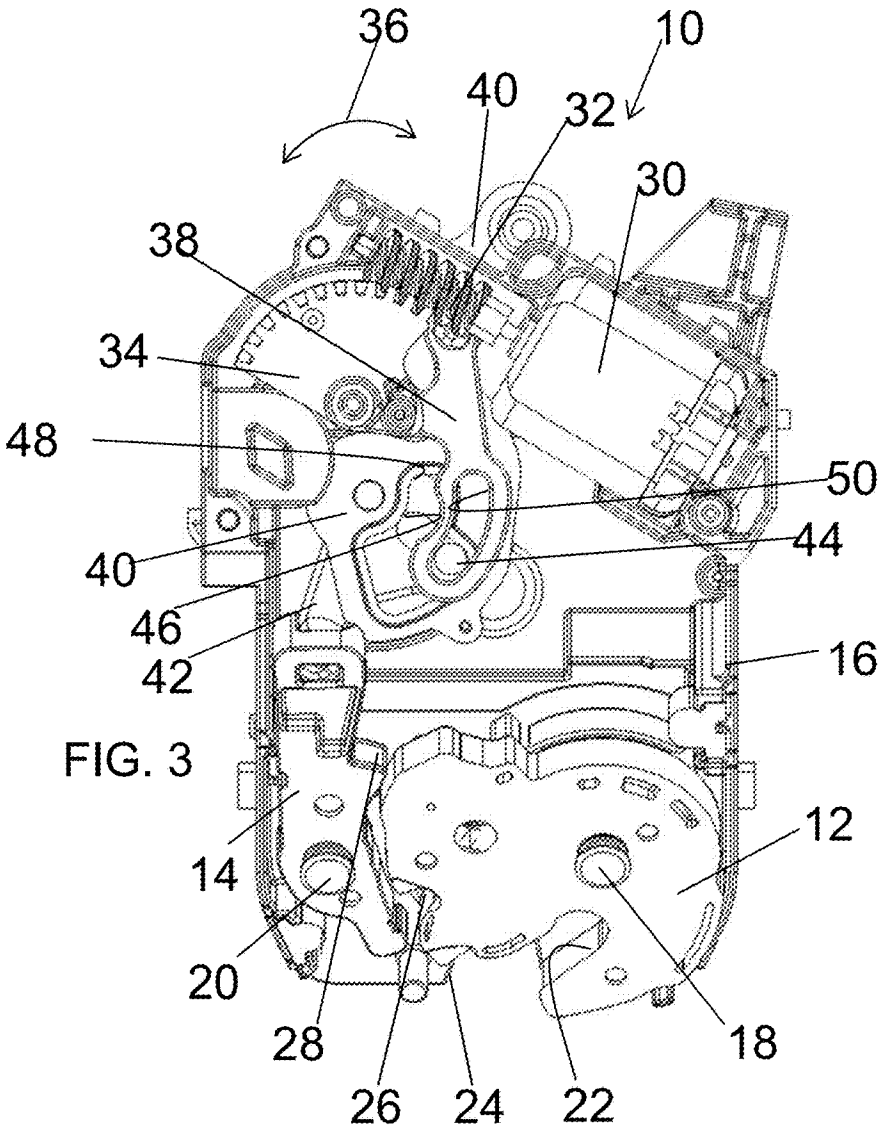
FIG. 3 is a view of the latch in an open and unlocked position.
Figure 3A:
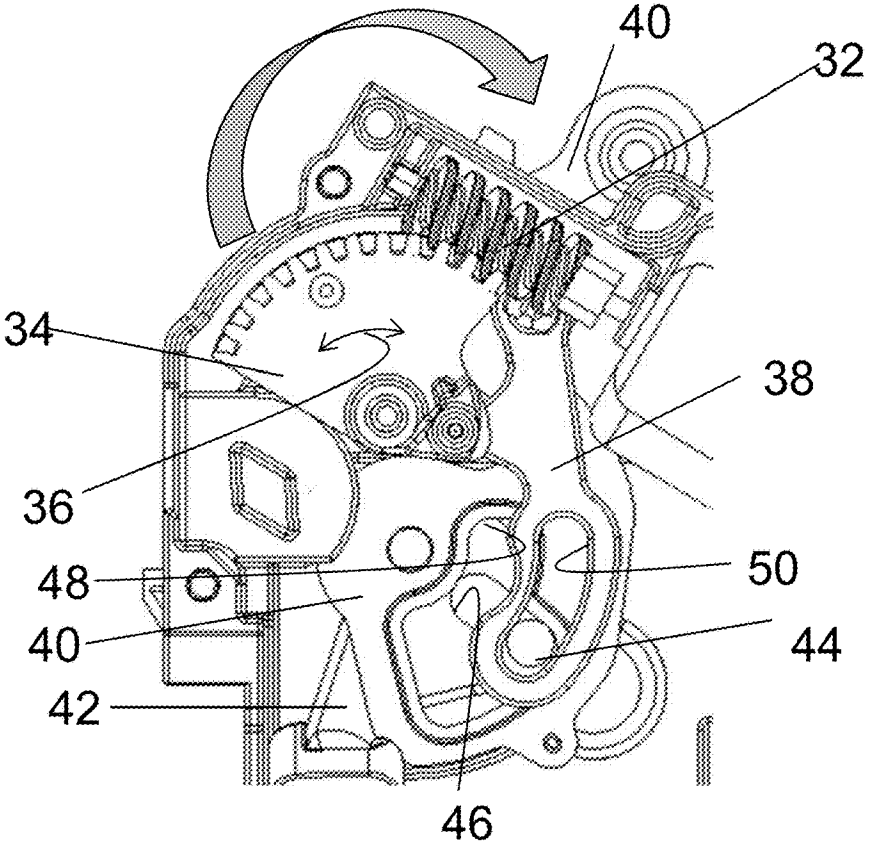
FIG. 3A is an enlarged view of a portion the latch illustrated in FIG. 3.
Figure 4:
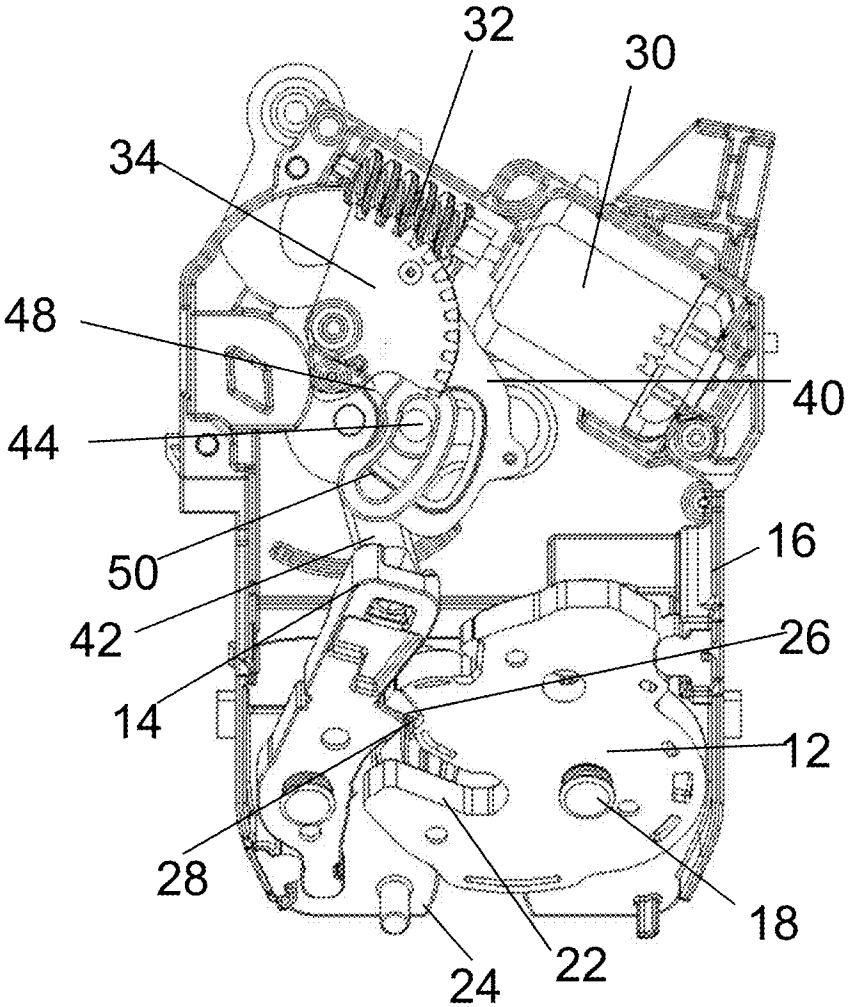
FIG. 4 is a view of the latch in a closed and locked position.
Figure 4A:
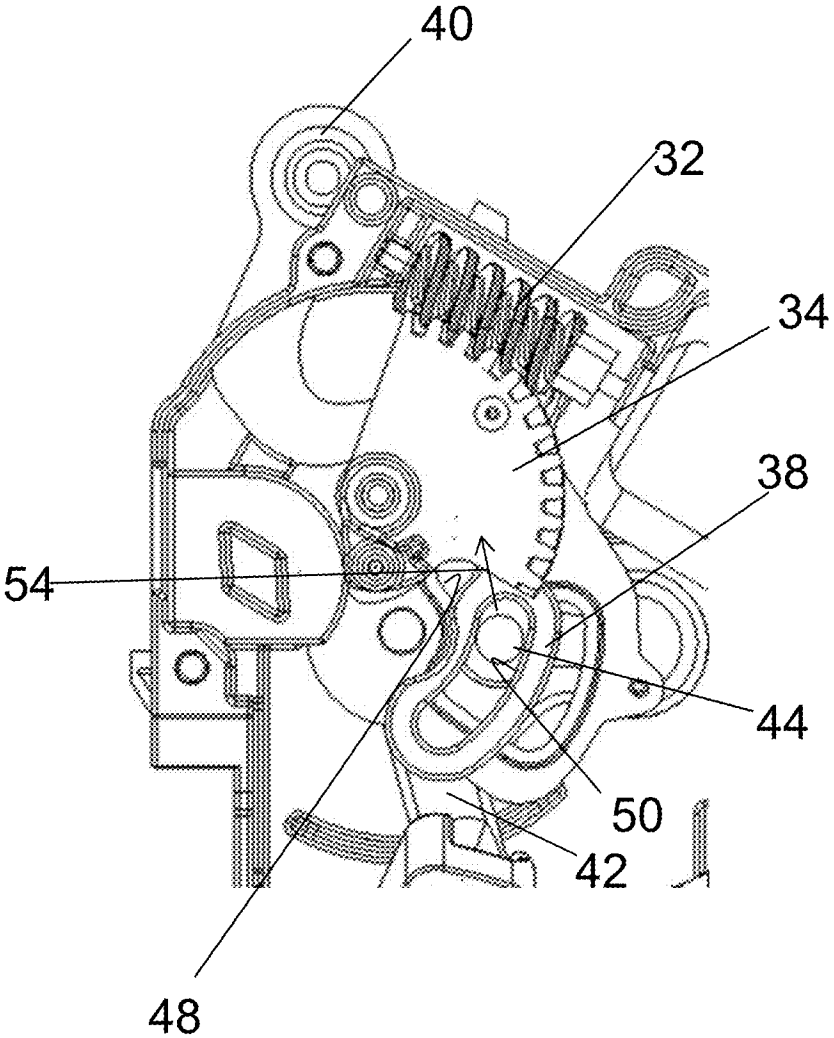
FIG. 4A is an enlarged view of a portion the latch illustrated in FIG. 4.
Figure 5:
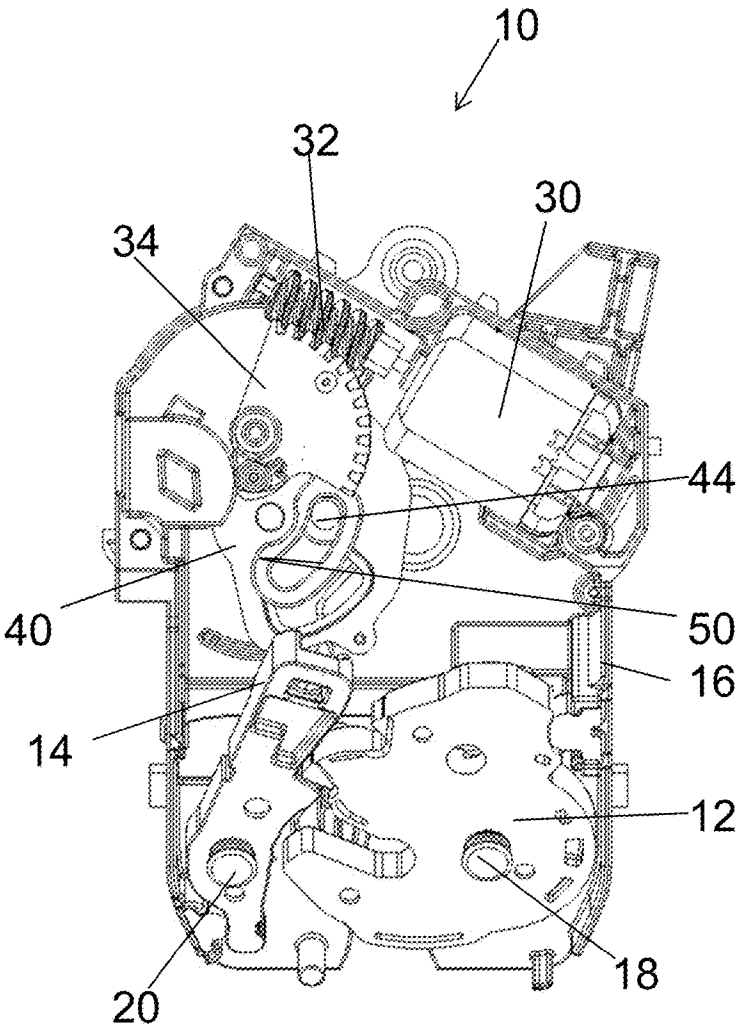
FIG. 5 is a view of the latch in a locked and a bypassed position.
Figure 5A:
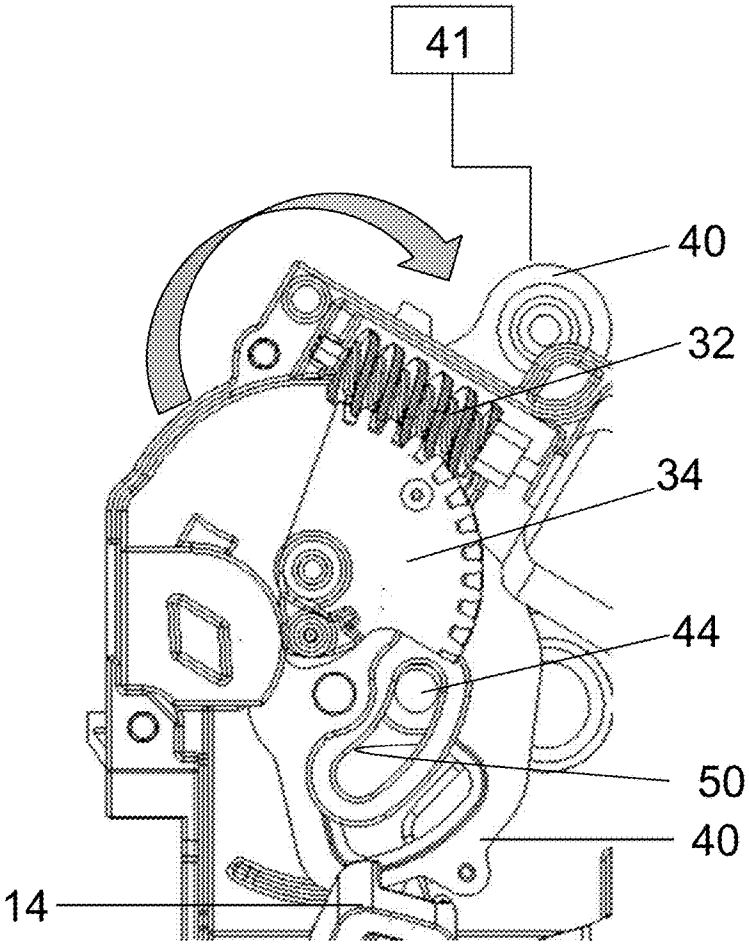
FIG. 5A is an enlarged view of a portion the latch illustrated in FIG. 5A.

During operation and in order to retain the latch 10 or fork bolt 12 in the latched position, the detent lever or pawl 14 is pivotally secured to the latch 10 for movement between an engaged position or latched position (see at least FIGS. 1, 2, 4 and 5) and a disengaged position or released position (see at least FIG. 3). When the detent lever 14 is in the engaged position, a surface 26 of the fork bolt 12 is engaged by a surface 28 of the detent lever 14 and the fork bolt 12 is prevented from moving toward the unlatched position from the latched position. In one non-limiting implementation, a first spring may be provided for biasing the fork bolt 12 into the open position while a second spring may be provided for biasing the detent lever 14 in the direction of the engaged position, such that movement of the fork bolt to the latched position will cause the detent lever 14 to move to the engaged position.

The latch 10 further comprises a motor 30 configured to drive a worm gear 32. The worm gear 32 is configured to mesh with a sector gear or worm sector gear 34 that is rotatably mounted to the latch 10. The sector gear 34 is configured for movement in the direction of arrows 36 between a first position or unlocked position (See at least FIGS. 1, 2, 2A, 3 and 3A) and a second or locked position (See at least FIGS. 4, 4A, 5 and 5A).

An intermittent lever 38 is operatively coupled to the sector gear 34 such that as the sector gear 34 moves between the first position and the second position, the intermittent lever 38 moves between a first position (See at least FIGS. 1, 2, 2A, 3 and 3A) and a second position (See at least FIGS. 4, 4A, 5 and 5A). In one embodiment, the movement of the intermittent lever 38 is also achieved by means of a cam surface of the worm gear 34 rotatably mounted about the same axes of the worm gear or worm sector gear 34 and the intermittent lever 38 such that as the worm sector gear 34 moves, the cam surface contacts and moves the intermittent lever 38. In other words, movement of the sector gear 34 from the first position to the second position causes the gear 34 via the cam surface to contact and move the intermittent lever 38 from its first position to its second position.

The latch 10 also comprises a release lever or unlatching lever or manual release 40 that is movably, pivotally or rotatably mounted to the latch for movement between a first position (See at least FIGS. 1, 2, 2A, 3 and 3A) and a second position (See at least FIGS. 4, 4A, 5 and 5A) in the direction of arrows 36. When the latch 10 is in the unlocked position (See at least FIGS. 1, 2, 2A, 3 and 3A) movement of the release lever 40 is transferred to the detent lever 14 so that the detent lever 14 can be moved into the disengaged position and therefore the fork bolt 12 can be moved into the unlatched position. In one non-limiting embodiment, the release lever 40 may be operatively coupled to a handle 41 (illustrated schematically in the FIGS.) of a vehicle door the latch is secured to. The handle 41 may be an inside handle or an outside handle, which when moved causes the movement of the release lever 40.

When the latch 10 is in the locked position (See at least FIGS. 4, 4A, 5 and 5A) movement of the release lever 40 is not transferred to the detent lever 14 so that the detent lever 14 remains in the engaged position regardless of the movement of the release lever 40.

The release lever 40 is operatively coupled to the detent lever 14 via a bell crank lever 42. An intermittent pin 44 operatively couples the release lever 40 to the bell crank lever 42 in order to transmit, when applicable, the desired movement to the detent lever 14.

The intermittent pin 44 is slidably received within a slot or opening 46 in the bell crank lever 42 as well as a slot or opening 48 in the release lever 40. The intermittent pin 44 is also movable between a first position (See at least FIGS. 1, 2, 2A, 3 and 3A) which corresponds to an unlocked position of the latch 10 and a second position (See at least FIGS. 4, 4A, 5 and 5A) which corresponds to a locked position of the latch 10.

When the latch 10 is in the first position or unlocked position and accordingly the intermittent pin 44 is in the first position, movement of the release lever 40 is transferred to the bell crank lever 42 via intermittent pin 44 and the movement of the bell crank lever 42 caused by the release lever 40 is also transferred to the detent lever 14 due to the position of the intermittent pin 44. In other words, pin 44 contacts the edges of slots or openings 46 and 48 so that movement of the release lever 40 is transferred to the detent lever 14 due to the position of the intermittent pin 44.

If on the other hand the latch is in the second position or locked position and accordingly the intermittent pin 44 is in the second position, movement of the release lever 40 is not transferred to the bell crank lever 42 as pin 44 will move within opening 48 of the release lever 40. In other words, the intermittent pin 44 bypasses the bell crank lever 42 allowing the unlatching or release lever 40 to move within its full range of travel without transmitting the movement of the release lever 40 to the detent lever 14.

The intermittent pin 44 is operatively coupled to the intermittent lever 38 and is slidably received within a slot or opening 50 of the intermittent lever 38. Accordingly and as the intermittent lever 38 is moved between the first and second positions via the sector gear 34 the intermittent pin 44 is moved between its first and second positions.

As illustrated in the attached FIGS. and when the sector gear 34 is moved to its second position via motor 30, the intermittent pin 44 moves from its first position to its second position in the direction of arrow 52 and in slot or opening 46 of the bell crank lever 42.

Once the intermittent pin 44 is in its second position it is now aligned with an upper slot or opening 48 of the release lever 40 such that should the release lever 40 be moved from its first position to its second position when the intermittent pin 44 is in its second position the intermittent pin 44 will be allowed to move in the direction of arrow 54 and not contact an edge of opening 48 so that the movement of the release lever 40 will not be transferred to the bell crank lever 42. In other words, the slot or opening 48 on the release lever 40 is configured to allow the intermittent pin 44 to not be moved by the release lever 40 and thus not engage the bell crank lever 42 when the release lever 40 is moved. Accordingly, the movement of the release lever 40 will not be transferred to the bell crank lever 42 and thus the detent lever 14 will not be moved. Accordingly and when the intermittent pin 44 is in its second position, the intermittent pin 44 bypasses the bell crank lever 42 allowing the release lever 40 to move in its full range of motion without transmitting the movement to the detent lever 14.

Also shown is that the intermittent pin 44 is also slidably received within the slot or opening 50 of the intermittent lever 38 and movement of the intermittent lever 38 moves the intermittent pin 44 between its first position and its second position.

Figure 6:
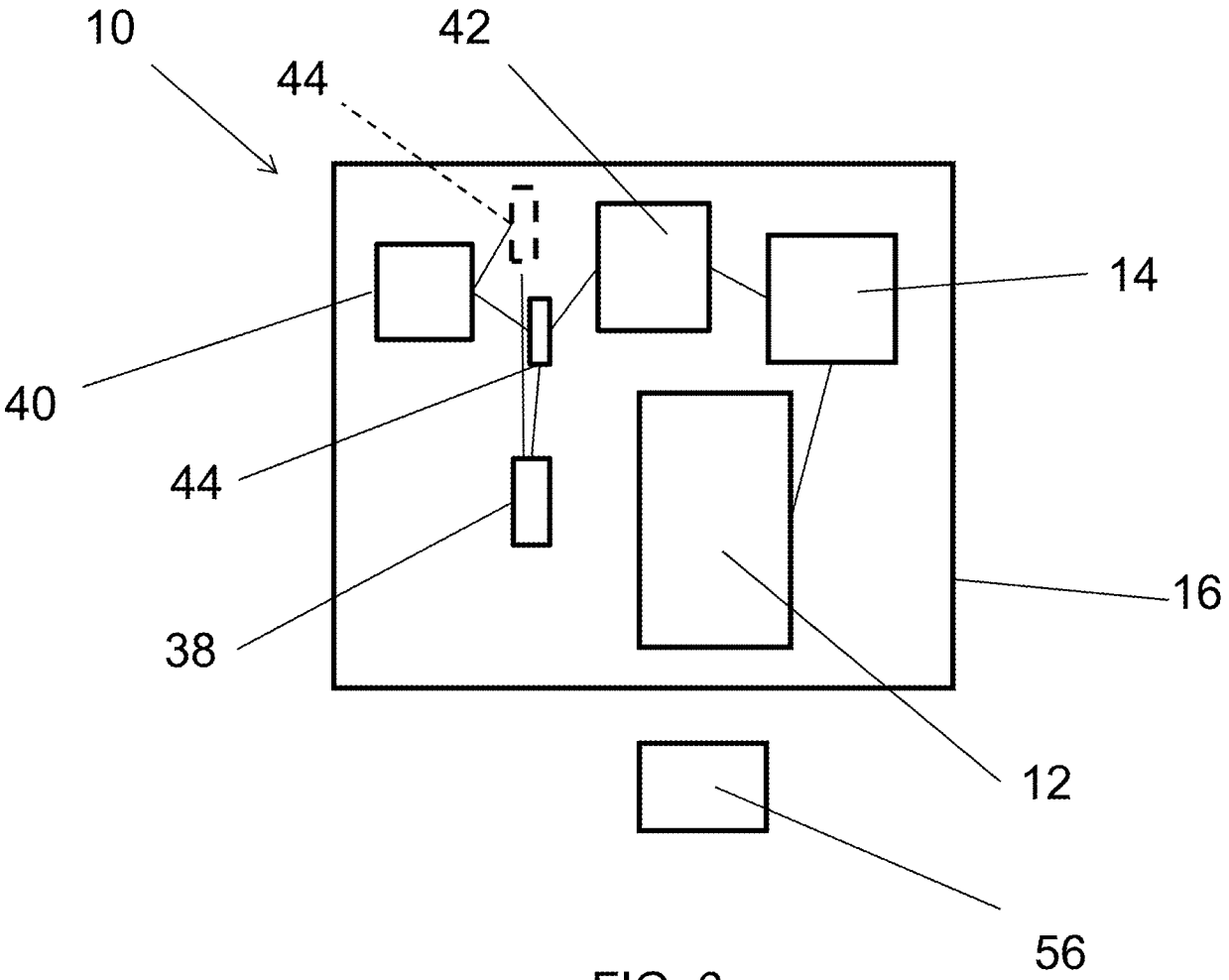
FIG. 6 is a schematic illustration of a latch constructed in accordance with one embodiment of the present invention.

FIG. 6 schematically illustrates a latch 10 with a fork bolt 12 and detent lever 14 illustrated schematically. Also shown schematically are the bell crank 42, release lever 40, intermittent lever 38 and the intermittent pin 44. As is known in the related arts, fork bolt 12 is configured to receive, capture and release a striker 56 when it is inserted into an opening of a housing 16 of the latch 10. The dashed lines in FIG. 6 schematically illustrate the second position of the intermittent pin 44 and its disconnection from the bell crank lever 42, which in one non-limiting embodiment allows the release lever 40 (via the lack of line between dashed box 44 and box 42 which illustrates via the lack of connecting line between the dashed box 44 and box 42 the disengagement of release lever 40 from the bell crank lever 42) to be moved to its second position without transferring the movement of the release lever 40 to the bell crank lever 42 and ultimately detent lever 14. Thus and in one non-limiting exemplary embodiment and when the intermittent lever 38 is in its second position, forces transmitted to the release lever 40 are not transferred to the bell crank lever 42 as well as the detent lever 14.

Accordingly, one embodiment of the present invention provides an intermittent component that translates a pin 44 into a bypassed condition (e.g., locked wherein forces applied to the release lever 40 are not transferred to the bell crank lever 42) or into a non-bypassed condition (e.g., unlocked wherein forces applied to the release lever 40 are transferred to the bell crank lever 42). This configuration does not add any bending stresses to the intermittent lever 38 when the latch is unlocked and the release lever 40 is pulled. This can be achieved due to the fact that the intermittent pin 44 is concentric to the rotation of the levers. The movement of the intermittent lever 38 is also achieved by means of a cam surface mounted to the worm gear 34 for rotation about the same axis of the worm gear sector 34.

Often in the door latching system industry, issues arise when confronted with the available packaging environment. Compounding the design issues are the requirements of the vehicles the latches are placed in such as electric locking, manual release handle and lock lever interfaces. Exemplary embodiments of the present invention allows for bypass functions without adding complexity to the latch 10.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

What is claimed is:

1. A method of disengaging a release lever from a bell crank lever of a vehicle door latch, comprising:

pivotally mounting a fork bolt to the vehicle door latch for movement between an open position and a closed position;

pivotally mounting a detent lever to the vehicle door latch for movement between a latched position and a released position, wherein the detent lever engages the fork bolt and prevents the fork bolt from moving from the closed position to the open position when the detent lever is in the latched position;

movably mounting a bell crank lever to the vehicle door latch for movement between a first position and a second position, wherein the bell crank lever is configured to move the detent lever from the latched position to the released position as it moves from the first position to the second position;

movably mounting a release lever to the vehicle door latch for movement between a first position and a second position;

operatively coupling the bell crank lever to the release lever by an intermittent pin, wherein the intermittent pin is movably mounted to the bell crank lever and the release lever for movement between a first position and a second position, wherein movement of the release lever is not transferred to the bell crank lever when the intermittent pin is in the second position, and the intermittent pin is moved from its first position to its second position when an intermittent lever is moved from a first position to a second position by a sector gear when the sector gear is moved from a first position to a second position.

2. The method as in claim 1, wherein movement of the release lever is transferred to the bell crank lever when the intermittent pin is in the first position.

3. The method as in claim 1, wherein the intermittent pin is slidably received within a slot of the bell crank lever and a slot of the release lever.

4. The method as in claim 3, wherein movement of the release lever is transferred to the bell crank lever when the intermittent pin is in the first position.

5. The method as in claim 4, wherein the intermittent pin is moved from the first position to the second position by an intermittent lever.

6. The method as in claim 1, wherein movement of the release lever is transferred to the bell crank lever when the intermittent pin is in the first position.

7. The method as in claim 6, wherein the intermittent pin is slidably received within a slot of the bell crank lever and a slot of the release lever.

8. The method as in claim 7, wherein the intermittent pin is slidably received within a slot of the intermittent lever.

9. The method as in claim 1, wherein the sector gear is moved to its second position by a motor.

10. The method as in claim 9, wherein a configuration of a slot of the release lever allows movement of the release lever to be uncoupled from the bell crank lever when the intermittent pin is in its second position.

11. The method as in claim 1, wherein movement of the release lever is transferred to the bell crank lever when the intermittent pin is in the first position and the intermittent pin is slidably received within a slot of the bell crank lever, the release lever and the intermittent lever.

12. The method as in claim 1, wherein the vehicle door latch is a rear door latch.

13. The method as in claim 12, wherein movement of the release lever is transferred to the bell crank lever when the intermittent pin is in the first position.

14. The method as in claim 12, wherein the intermittent pin is slidably received within a slot of the bell crank lever and the release lever.

15. The method as in claim 12, wherein movement of the release lever is transferred to the bell crank lever when the intermittent pin is in the first position.

* * * * *